US006997389B2

(12) United States Patent
Demster

(10) Patent No.: US 6,997,389 B2
(45) Date of Patent: Feb. 14, 2006

(54) METHOD AND APPARATUS FOR DELIVERING CONDITIONED AIR USING PULSE MODULATION

(75) Inventor: Stanley J. Demster, Lenexa, KS (US)

(73) Assignee: Airfixture L.L.C., Kansas City, MO (US)

( * ) Notice: Subject to any disclaimer, the term of this patent is extended or adjusted under 35 U.S.C. 154(b) by 0 days.

(21) Appl. No.: 10/606,094

(22) Filed: Jun. 25, 2003

(65) Prior Publication Data

US 2004/0007001 A1 Jan. 15, 2004

Related U.S. Application Data

(62) Division of application No. 10/150,266, filed on May 17, 2002.

(51) Int. Cl.
*F24F 7/06* (2006.01)

(52) U.S. Cl. ..... 236/46 R; 236/49.3; 165/269

(58) Field of Classification Search ..... 236/46 F, 236/46 R, 46 A, 49.3; 62/231; 165/238, 267, 165/269

See application file for complete search history.

(56) References Cited

U.S. PATENT DOCUMENTS

| | | | | |
|---|---|---|---|---|
| 2,793,508 A | | 5/1957 | Mueller | |
| 3,680,701 A | | 8/1972 | Holca | |
| 3,720,258 A | | 3/1973 | Chandler | |
| 3,949,808 A | | 4/1976 | Gilles | |
| 4,077,310 A | | 3/1978 | McCabe, Jr. et al. | |
| 4,244,193 A | | 1/1981 | Haakenson | |
| 4,258,615 A | | 3/1981 | Vivian | |
| 4,407,445 A | | 10/1983 | Vivian | |
| 4,497,182 A | | 2/1985 | Youngworth | |
| 4,547,286 A | | 10/1985 | Hsiung | |
| 4,552,304 A | * | 11/1985 | Papazian | 236/46 F |
| 4,562,883 A | | 1/1986 | Janeke | |
| 4,608,181 A | | 8/1986 | Hsiung et al. | |
| 4,683,942 A | | 8/1987 | Bierkamp et al. | |
| 4,719,761 A | | 1/1988 | Cromer | |
| 4,722,475 A | * | 2/1988 | Newell et al. | 236/46 R |
| 4,769,053 A | | 9/1988 | Fischer, Jr. | |
| 4,793,934 A | | 12/1988 | Thompson et al. | |
| 4,824,012 A | | 4/1989 | Tate | |
| 4,838,483 A | | 6/1989 | Nurczyk et al. | |
| 4,919,327 A | | 4/1990 | Elluin et al. | |
| 4,928,750 A | | 5/1990 | Nurczyk | |
| 4,931,948 A | | 6/1990 | Parker et al. | |
| 5,033,361 A | | 7/1991 | Moszkowski | |
| 5,065,585 A | | 11/1991 | Wylie et al. | |
| 5,076,346 A | * | 12/1991 | Otsuka | 165/217 |
| 5,080,808 A | | 1/1992 | Kim et al. | |
| 5,103,896 A | | 4/1992 | Saga | |
| 5,117,900 A | | 6/1992 | Cox | |
| 5,179,998 A | | 1/1993 | Des Champs | |
| 5,192,020 A | * | 3/1993 | Shah | 236/46 R |
| 5,198,124 A | | 3/1993 | Kim et al. | |
| 5,265,442 A | | 11/1993 | Lamie | |
| 5,275,333 A | | 1/1994 | Tamblyn | |

(Continued)

*Primary Examiner*—William E. Tapolcai
(74) *Attorney, Agent, or Firm*—Shook, Hardy & Bacon L.L.P.

(57) ABSTRACT

A method and apparatus for delivering conditioned air using short duty cycles during which a damper is fully open for a time and fully closed for the remaining time. Conditioned air is continuously supplied to a plenum at low pressure and is applied to the space when the damper is open and blocked when the damper is closed. The proportion of on to off time during each duty cycle is adjusted to meet the load. When several supply terminals serve a space, their duty cycles are staggered to avoid fan instability. A special motor is coupled directly to the damper shaft for fast opening and closing of the damper. A magnetic latch holds the damper open or closed until the motor moves it again.

16 Claims, 11 Drawing Sheets

U.S. PATENT DOCUMENTS

| | | | | | |
|---|---|---|---|---|---|
| 5,313,803 | A | | 5/1994 | Detzer | |
| 5,314,630 | A | | 5/1994 | Kim et al. | |
| 5,467,919 | A | | 11/1995 | Tamblyn | |
| 5,495,724 | A | | 3/1996 | Koster | |
| 5,725,148 | A | | 3/1998 | Hartman | |
| 5,743,101 | A | | 4/1998 | Shida et al. | |
| 5,775,125 | A | | 7/1998 | Sakai et al. | |
| 5,810,245 | A | | 9/1998 | Heitman et al. | |
| 5,890,372 | A | | 4/1999 | Belding et al. | |
| 5,911,747 | A | | 6/1999 | Gauthier | |
| 5,996,354 | A | | 12/1999 | Sokolean et al. | |
| 6,019,677 | A | | 2/2000 | Demster | |
| 6,021,644 | A | | 2/2000 | Ares et al. | |
| 6,099,406 | A | | 8/2000 | Demster | |
| 6,185,943 | B1 | | 2/2001 | Kopko | |
| 6,318,639 | B1 | * | 11/2001 | Toth | 236/46 R |
| 6,405,543 | B1 | | 6/2002 | Kopko | |
| RE38,406 | E | * | 1/2004 | Faris et al. | 388/831 |
| 2001/0048030 | A1 | | 12/2001 | Sharood et al. | |
| 2002/0017571 | A1 | | 2/2002 | Riley et al. | |

* cited by examiner

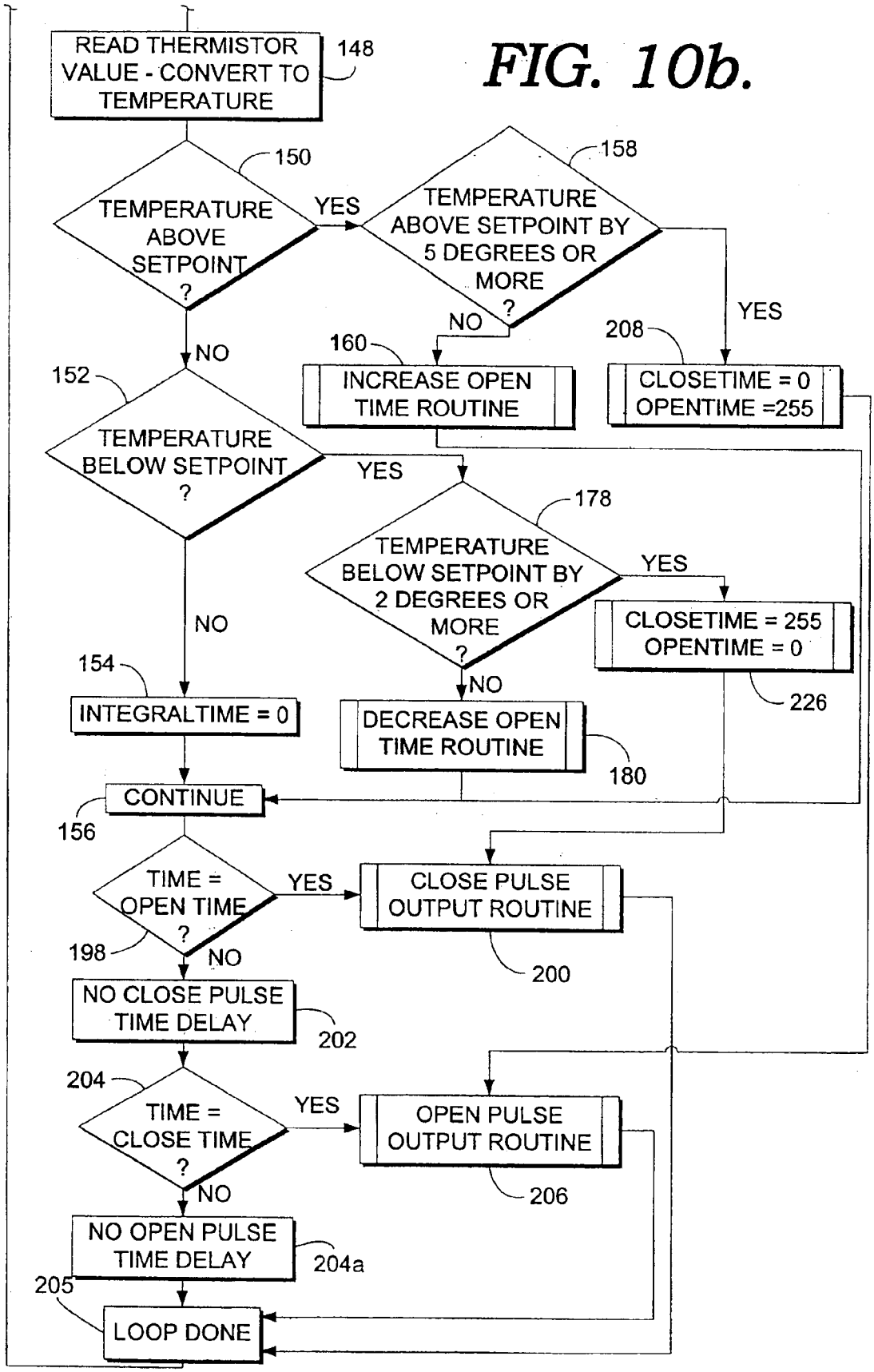
READ THERMISTOR VALUE - CONVERT TO TEMPERATURE
148
FIG. 10b.
150
TEMPERATURE ABOVE SETPOINT ?
YES
158
TEMPERATURE ABOVE SETPOINT BY 5 DEGREES OR MORE ?
NO
YES
160
INCREASE OPEN TIME ROUTINE
208
CLOSETIME = 0
OPENTIME =255
NO
152
TEMPERATURE BELOW SETPOINT ?
YES
178
TEMPERATURE BELOW SETPOINT BY 2 DEGREES OR MORE ?
YES
CLOSETIME = 255
OPENTIME = 0
226
NO
154
INTEGRALTIME = 0
NO
DECREASE OPEN TIME ROUTINE
180
CONTINUE
156
TIME = OPEN TIME ?
YES
CLOSE PULSE OUTPUT ROUTINE
200
198
NO
NO CLOSE PULSE TIME DELAY
202
204
TIME = CLOSE TIME ?
YES
OPEN PULSE OUTPUT ROUTINE
206
NO
NO OPEN PULSE TIME DELAY
204a
205
LOOP DONE

METHOD AND APPARATUS FOR DELIVERING CONDITIONED AIR USING PULSE MODULATION

CROSS-REFERENCE TO RELATED APPLICATIONS

This application is a divisional of U.S. Ser. No. 10/150,266, filed May 17, 2002 and entitled "Method and Apparatus for Delivering Conditioned Air Using Pulse Modulation".

FIELD OF THE INVENTION

This invention relates generally to the delivery of conditioned air for heating, cooling, ventilating and/or otherwise treating the air in buildings and other spaces. More particularly, the invention is directed to a method and apparatus that makes use of pulse modulation techniques for the delivery of air.

BACKGROUND OF THE INVENTION

Conventional systems for delivering air for the heating and cooling of buildings use one of three different techniques. A constant volume system continuously supplies a constant volume of air and varies the temperature of the air that is being supplied in order to achieve a temperature change in the space. Variable volume systems operate under simple on/off control or use analog throttling damper or fan modulation to vary the flow rate.

All of these conventional systems have serious shortcomings. A typical constant volume system uses a thermostat in the space that senses the ambient temperature and sends a feedback signal. If the air temperature is above the set point temperature, the air supply temperature is reduced. Conversely, the air supply temperature is increased if the sensed temperature is below the set point. Although constant volume systems are relatively simple and provide good ventilation, they have suffered a decline in popularity due primarily to their energy inefficiency. The problem is that when the load is low, a constant volume system delivers more air than is necessary to maintain the set point temperature. This results in a waste of fan energy which takes on increasingly adverse significance as energy costs increase.

Variable volume on/off systems are widely used because they are simple, economical to install and relatively inexpensive to operate. However, there are important disadvantages in that there is no ventilation during off cycles, the temperature in the space is non-uniform, there is considerable noise variation between on and off cycles, there is by necessity a significant dead band in the thermostat control, and they are not practical for use other than in single zone systems.

Variable volume systems that vary the flow using variable dampers or variable fans are advantageous in that they are able to closely track the load in the space and are efficient in fan energy use. However, they are also characterized by relatively high costs and complexity, noise variation caused by flow modulation, ineffective ventilation, and inadequate mixing at low air volumes and load.

Analog modulation techniques for varying the airflow are particularly disadvantageous when the air quantity is reduced under conditions of low loading. When the flow if reduced, there is also a reduction in the air momentum, velocity, air throw, air mixing and air induction. This results in poor comfort to the occupants of the space and a compromise in the thermal efficiencies of the system. These problems have been addressed by using air terminals in which the discharge area is restricted to maintain a relatively constant velocity as the flow rate is reduced. However, there is still a reduction of mass in the discharge air and associated limitations in the kinetic energy, momentum, mixing, induction and air throw. At low supply pressure, these problems are especially pronounced. For all of these reasons, the so-called constant velocity, variable area devices are deficient as to the range of loading conditions they can successfully handle.

Response rates have been another problem associated with variable damper mechanisms. Standard practice is to provide a slow opening and closing time for the damper in order to better match the dynamic response of the space to the response of the controls, the sensing elements and the damper mechanism. If the response is too rapid, unstable control of the damper can result and cause a "hunting" condition in which the damper is repeatedly repositioned without producing the correct air quantity. Conversely, if the damper opens and closes too slowly, the control of the temperature in the space suffers. This condition is referred to as "drift" and often results from efforts at avoiding the hunting effect at the expense of transient response. Reaching a compromise where the system is well tuned is always challenging and often labor intensive even if successful.

A further problem with prior art dampers is that they are subject to noise that results mainly when the air velocity changes. Air flowing through small areas at low flow rates can cause vibration of the hardware components and can also result in objectionable noise from the air itself. The result is that noise at objectionable levels can be produced, with varying noise at different flow rates making the situation even less acceptable.

Treating air in other ways such as for high or low humidity, oxygen depletion, or excessive carbon dioxide is subject to the same problems.

BRIEF SUMMARY OF THE INVENTION

The present invention is directed to an improved method and apparatus for delivering conditioned air that makes use of pulse modulation to overcome or at least significantly reduce the problems that have plagued air delivery systems in the past.

It is an important object of the invention to provide a method and apparatus for delivering air in a manner to achieve full mass, full kinetic energy, full momentum, full induction, and maximum flow and velocity for complete mixing of the supply air with the air in the space regardless of the load conditions.

Another important object of the invention is to provide a method and apparatus of the character described that makes use of a low supply pressure (preferably less than 0.25 inch w.g.).

A further object of the invention is to provide a method and apparatus of the character described that generates only minimal noise (preferably noise that is inaudible to humans in a typical environment).

A still further object of the invention is to provide a method and apparatus of the character described in which there is no "hunting" or "drifting" of a damper or other flow control device.

Yet another object of the invention is to provide a method and apparatus of the character described that is economical to install and efficient in operation.

Still another object of the invention is to provide a method and apparatus of the character described in which the set point temperature can be closely maintained to maximize comfort in the area to which conditioned air is being supplied.

Another object of the invention is to provide an improved air terminal and damper construction that exhibits improved performance in the delivery of conditioned air to buildings and other spaces, particularly in the areas of effective mixing, more uniform temperatures, less fan energy use, effective ventilation, and in other performance characteristics.

A still further object of the invention is to provide, in a method and apparatus of the character described, a terminal unit that does not require balancing.

Yet another object of the invention is to provide a method and apparatus of the character described in which variable air volume and constant air volume devices can be used in the same system. In this regard, the air terminal unit has a maximum air flow volume that depends on the discharge area of the outlet rather than on a damper. Consequently, some of the terminals can be equipped with dampers to achieve variable air volume operation (by means of pulse modulation), and other terminals can lack a damper to operate in a constant volume mode.

A further object of the invention is to provide a method and apparatus of the character described in which the terminals are pressure dependent. Because the terminal air volume is controlled by the pressure and the duration of the damper open condition during each duty cycle, the pressure can be varied to achieve different throw characteristics of the terminal. At the same time, the damper provides the desired volume rate of flow independently of the pressure.

These and other objects are achieved by providing a uniquely arranged air delivery system that uses pulse modulation to control the delivery of conditioned air. In accordance with a preferred embodiment of the invention, conditioned air is supplied at a low pressure to one or more terminal units that apply the air. Each terminal unit is equipped with one or more specially constructed dampers that are cycled between fully open and fully closed positions to either supply air at full velocity and throw or cut off the air almost completely.

The dampers are uniquely constructed to maintain the space at the set point temperature by opening during part of each relatively short duty cycle and closing during the remainder of the cycle. The ratio of time open to time closed during each cycle determines the time-averaged quantity of conditioned air that is delivered to the space and is dependent upon the load which is sensed by a thermostat or other control. The duty cycles occur intentionally faster than any temperature changes that the thermal sensor can detect. However, the average rate of flow resulting from the on/off cycles is controlled in a manner to keep the dampers open sufficiently that the average flow rate satisfies the set point temperature.

A "pulse" of air in the system of the present invention results from air delivered at full pressure and volume to the terminal unit for a period of time adequate to establish the full throw of the terminal. The duration of the damper opening is sufficient to allow the jet or plume of air to fully develop.

Among the advantages of this pulse modulation technique is that each damper is either fully open or fully closed and does not float at partially open positions. This binary type operation allows a low supply pressure to be used because whenever the damper is opened, it is fully open and delivers the air at full velocity, full mass and full throw so that thorough mixing is achieved with the same momentum and the same kinetic energy each time the damper opens. Consequently, low pressure flow can be taken advantage of without encountering significant difficulties, and the air distribution problems that are prevalent with variable volume prior art systems are avoided. Also, there are no noise problems or damper "drift" or "hunting" problems.

The present invention is characterized by a control system in which different dampers can be opened and closed at different times while maintaining the same duty cycle for each damper. Preferably, the terminals are controlled in a daisy chain fashion where an "open" pulse applied to the first terminal is delayed by a preselected time delay to the second terminal and by another time delay if a third terminal is present, and so on. The result is that each terminal has the same on/off cycle duration, but the cycles are staggered in time to stabilize the air delivery and fan operation. If all dampers opened at the same time and closed at the same time, the flow would go from zero to maximum all at once, and there would be unstable flow patterns and unstable fan conditions that could potentially cause problems.

The present invention further contemplates a terminal and damper drive construction that exhibits improved performance making them particularly well suited for use in a pulse modulated system, as well as in other types of systems that can take advantage of their performance characteristics. In this respect, the damper is controlled by a special motor that rapidly opens and closes the damper without objectionable noise and with only minimal wear over a large number of cycles. Further, the outlet size of the terminal unit can be made adjustable in order to provide a number of performance advantages.

Other and further objects of the invention, together with the features of novelty appurtenant thereto, will appear in the course of the following description.

BRIEF DESCRIPTION OF THE SEVERAL VIEWS OF THE DRAWING

In the accompanying drawings which form a part of the specification and are to be read in conjunction therewith and in which like reference numerals are used to indicate like parts in the various views.

DETAILED DESCRIPTION OF THE PREFERRED EMBODIMENT

Figure 1:
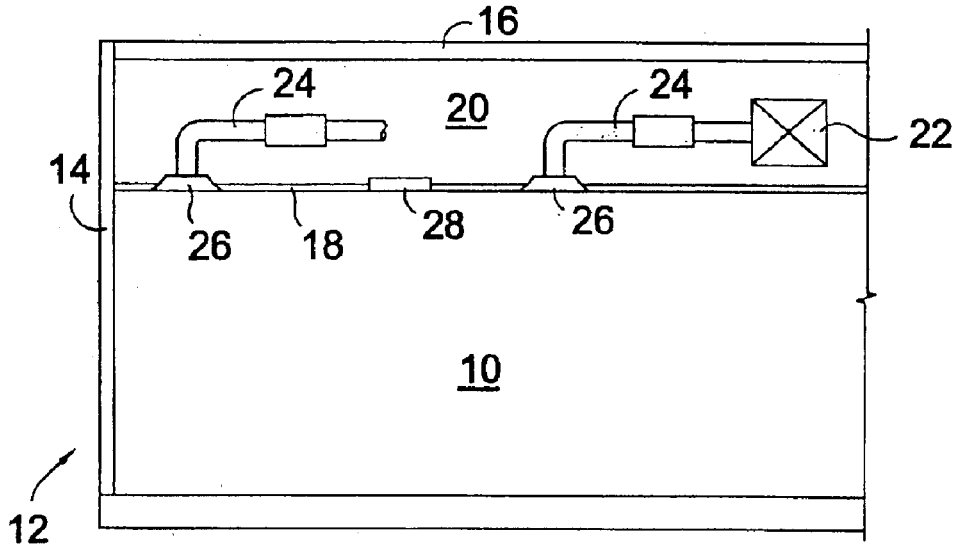
FIG. 1. PRIOR ART
FIG. 1 is a diagrammatic view of a conventional air delivery system of the type commonly found in the prior art.

Referring now to the drawings in more detail, FIG. 1 diagrammatically illustrates a typical prior art air delivery system of the type used to deliver conditioned air to a room 10 formed within a building 12 having walls 14 and a roof 16. A false ceiling 18 for the room 10 is spaced below the roof 16 in order to provide an open interstitial space 20 above the ceiling. A fan or other source of heated or cooled air (not shown) supplies conditioned air to a supply duct 22 which extends in the space 20. The duct 22 in turn supplies one or more smaller ducts 24 that lead to ceiling mounted terminals 26. The terminals 26 diffuse the condition air into the room 10. One or more return grills 28 which may be in the ceiling allow the return air to exhaust from the room 10. The fan (not shown) which supplies duct 22 and the heating or cooling unit which heats or cools the air are controlled in a conventional manner by a thermostat or other temperature sensor (also not shown) located within the room 10.

In order to provide sufficient space for installation of the ductwork and other equipment, it is typical for the space 20 to have a height of 36 inches or more between the ceiling 18 and the roof 16.

Figure 2:
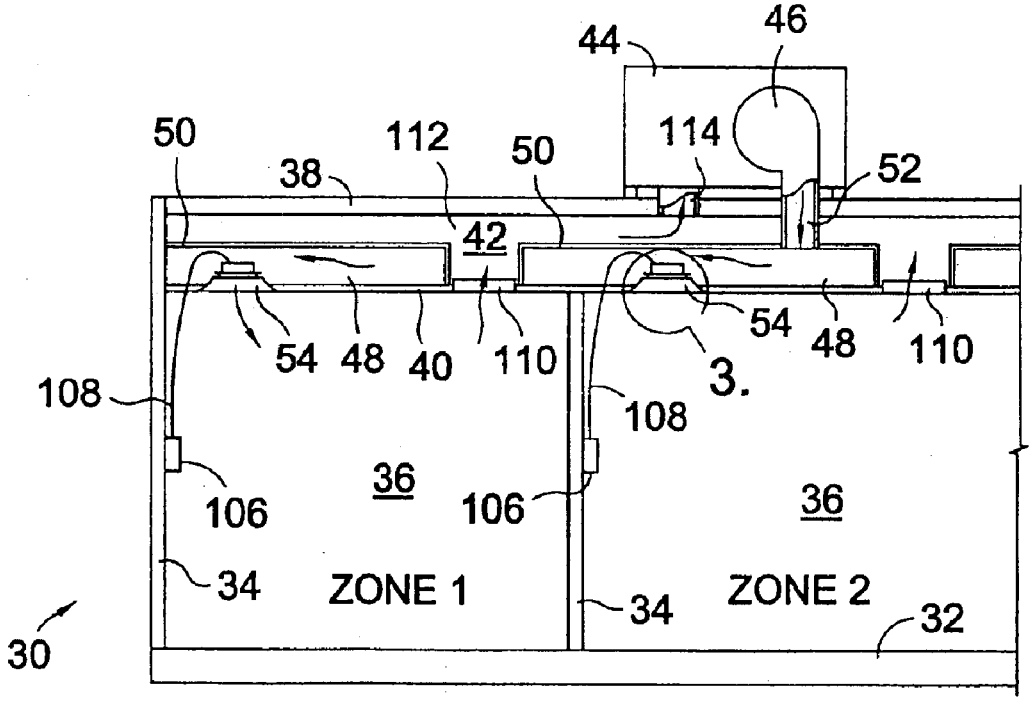
FIG. 2 is a diagrammatic elevational view of an air delivery system constructed according to a preferred embodiment of the present invention.

Referring now to FIG. 2 in particular, the present invention is directed to an air delivery system that is improved in a number of respects from the conventional system shown in FIG. 1 and other types of known systems. A building 30 includes a floor 32 and walls or partitions 34 which divide the space within the building into a number of different rooms 36. The building 18 has a roof 38, below which a false or dropped ceiling 40 is provided to overlie the rooms 36. An interstitial space 42 is provided between the ceiling 40 and the roof 38 but can be only approximately 18–24 inches high in contrast to the typical 36 inch height required of the space 20 in a conventional system such as that of FIG. 1.

The system of the present invention may be equipped with a roof top unit 44 that includes a fan 46 and suitable equipment (not shown) for heating and cooling air, as well as filters and other conventional devices. One or more supply plenums 48 are formed in the space 42 within enclosures 50 which may locate the plenum or plenums 48 immediately above the dropped ceiling 40. Preferably, there is only a single plenum 48 occupying a large portion of the interstitial space 42, although a number of plenums 48 all connected and receiving air at the same pressure can be used. The discharge side of the fan 46 connects with a duct 52 that leads to the plenums 48 in order to supply conditioned air to the plenums. Each supplied plenum 48 is provided with one or more terminal units 54 which may be mounted on the ceiling 40 and supply the conditioned air from the plenums 48 into the underlying rooms 36. Although for simplicity each plenum 48 is illustrated as having a single terminal unit 54, it is contemplated that each plenum 48 will be equipped with a relatively large number of the terminal units, as will be explained more fully.

Figure 3:
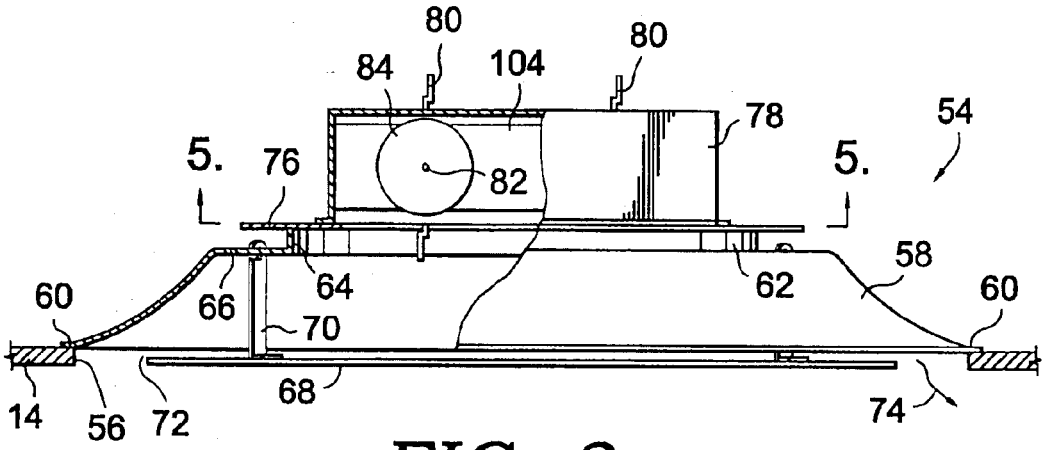
FIG. 3 is a fragmentary elevational view on an enlarged scale of the detail identified by numeral 3 in FIG. 2, with portions broken away for purposes of illustration.
Figure 4:
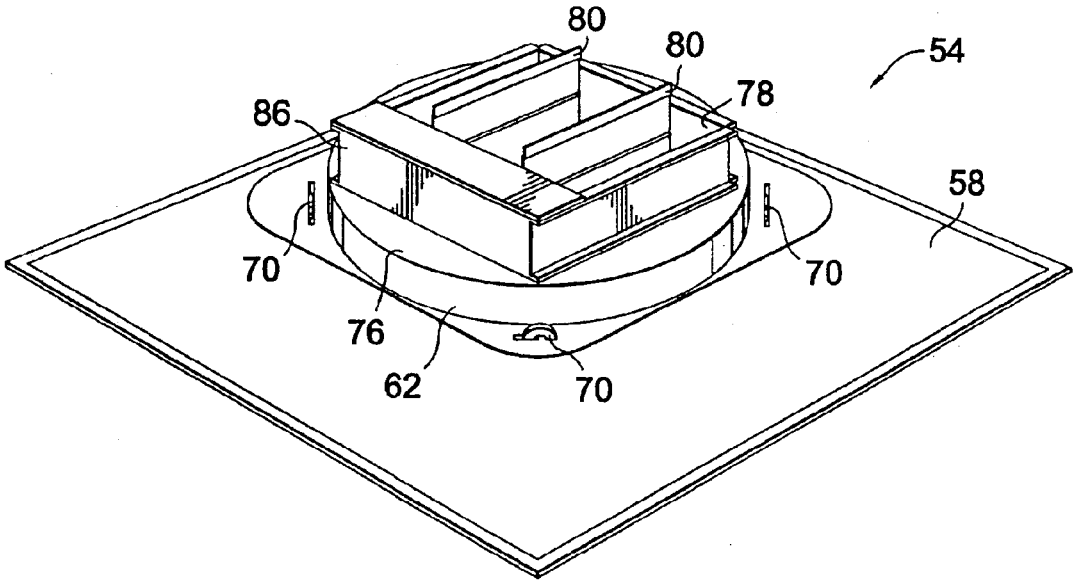
FIG. 4 is a top perspective view of an air terminal unit that may be incorporated in the present invention.

FIGS. 3 and 4 best illustrate the construction of each of the terminal units 54. Each of the terminal units 54 may be mounted adjacent to an opening 56 which is formed in the ceiling 14. Each terminal unit includes a hood 58 having bottom edges 60 that may rest on top of the ceiling 14 adjacent to the opening 56. An upturned cylindrical collar 62 is formed on the top portion of the hood 58 and presents within it a circular passage 64 through which the conditioned air flows downwardly into the interior of the hood.

The hood 58 includes an annular shoulder 66 which is horizontal and is located immediately outwardly of the collar 64. A horizontal baffle plate 68 is suspended from the shoulder 66 by a plurality of hanger brackets 70. The baffle 68 is located at approximately the same level as the ceiling 14 but is smaller than the opening 56 in order to provide an outlet 72 through which the air within hood 58 discharges into the underlying room, as indicated by the directional arrow 74 in FIG. 3.

A horizontal mounting plate 76 is secured on top of the collar 64 and supports a damper housing which is generally identified by numeral 78. The damper housing 78 may be rectangular and may be equipped with one or more dampers 80. As shown in the drawings, two dampers 80 may be provided, although a different number of dampers may be used in each terminal unit.

Figure 6:
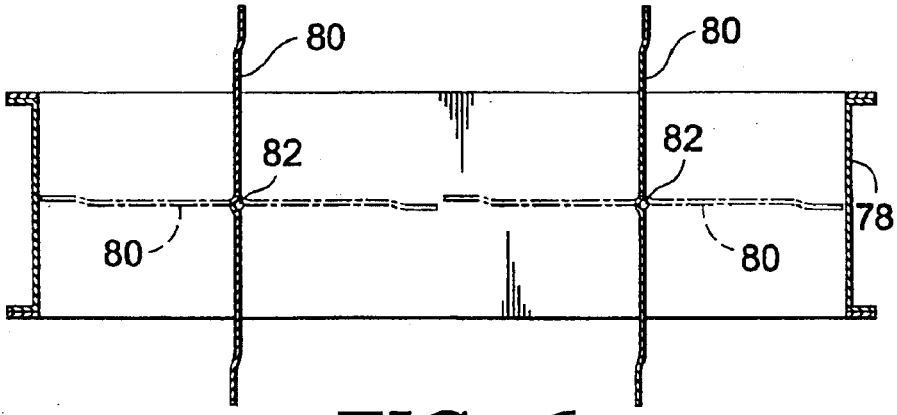
FIG. 6 is a sectional view taken generally along line 6—6 of FIG. 5 in the direction of the arrows, with the broken lines indicating the dampers in their closed positions.

The damper housing 78 has an open top that opens into the plenum 48 in order to receive the conditioned air that is supplied to the plenum. The flow of air downwardly through the damper housing 78 into the hood 58 is controlled by the dampers 80. As best shown in FIG. 6, each damper 80 may take the form of a flat damper blade mounted on a horizontal shaft 82. As the shafts 82 are turned, the dampers 80 rotate between the fully open position shown in solid lines in FIG. 6 and the fully closed position shown in broken lines in FIG. 6. In the fully open position, each damper 80 has a vertical orientation so that maximum flow through the damper housing 78 is provided. In the closed position, each damper 80 extends horizontally, and the two dampers occupy substantially the entirety of the inside of the damper housing 78 in order to substantially block the flow of conditioned air from the plenum 48 into the hood 58. The dampers 80 do not provide a perfect seal within the damper housing so that some air passes through the damper housing even when the dampers are closed. Thus, the construction provides controlled leakage when the dampers are closed. Each damper 80 rotates through an arc of 90° between the open and closed positions of the damper.

Figure 5:
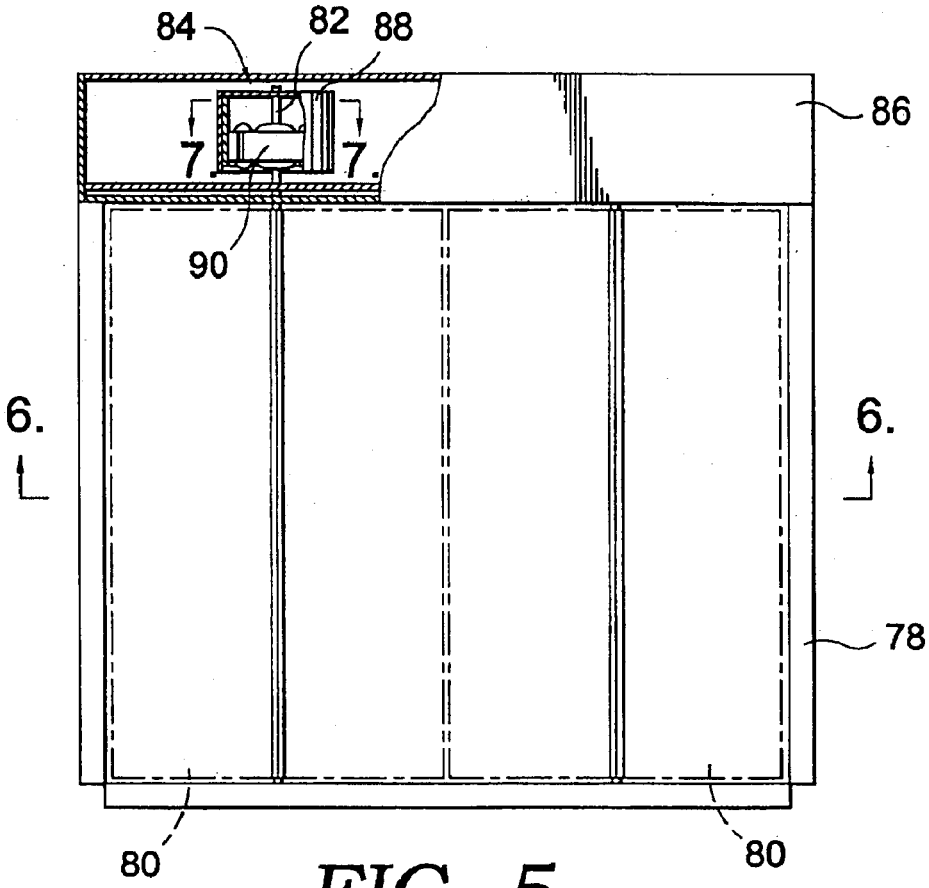
FIG. 5 is a sectional view taken generally along line 5—5 of FIG. 3 in the direction of the arrows, with a portion broken away for purposes of illustration.

Each of the dampers 80 is equipped with an actuator which may take the form of a special electric motor 84 for rotating the damper between its open and closed positions. As best shown in FIGS. 4 and 5, the motors 84 are mounted within a motor housing 86 secured to one end of the damper housing 78. The shafts 82 extend through the damper housing 78 and are supported for rotation on the damper housing. Each shaft 82 extends into the motor housing 86 and connects with a rotor 88 which forms part of the motor.

Figure 7:
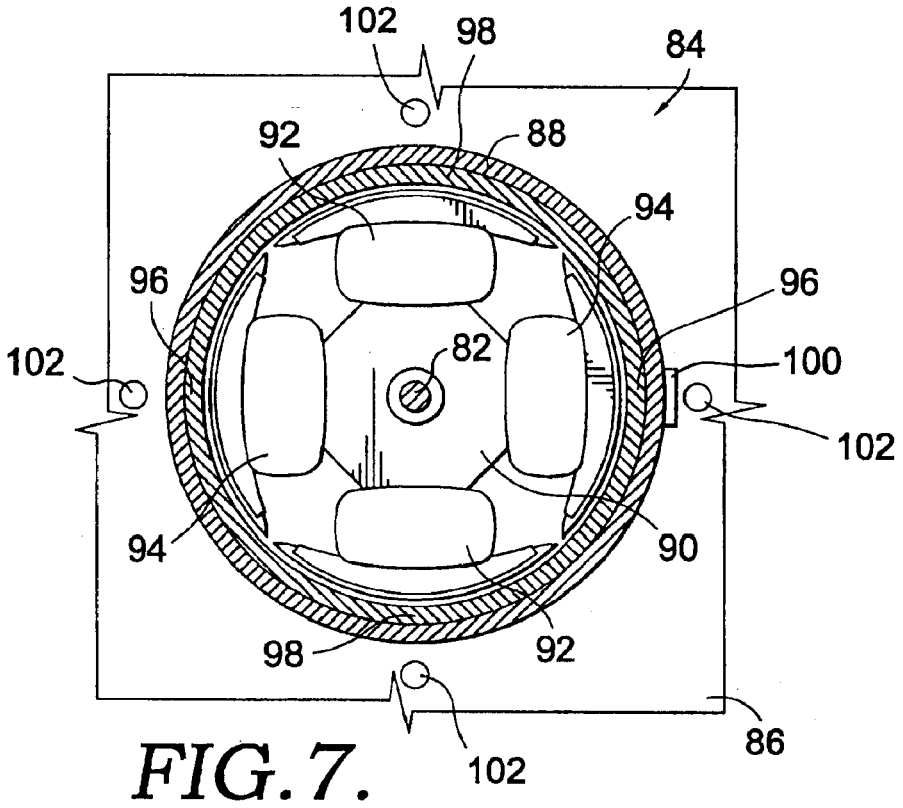
FIG. 7 is a fragmentary sectional view on an enlarged scale taken generally along line 7—7 of FIG. 5 in the direction of the arrows.

Referring to FIG. 7 in particular, each rotor 88 is cylindrical and is located outside of a stator 90 mounted to the housing 86. The stator 90 has one pair of opposed windings 92 which are maintained at the same polarity and another pair of opposed windings 94 that are maintained at the same polarity as one another but a different polarity than the windings 92. The rotor 88 is ferromagnetic and has a pair of opposite poles 96 that are of the same polarity as each other. Another pair of opposed poles 98 on the rotor 88 have the same polarity as each other but opposite to the poles 96. The current flow in the windings 92 and 94 may be reversed in order to actuate the motor and rotate the damper 80 through a 90° arc from the open position to the closed position or from the closed position to the open position.

The motor 84 is provided with a magnetic latching arrangement that includes a permanent magnet 100 mounted on the outside of the rotor 88 adjacent to one of the poles 96. Four metal studs 102 are secured to the housing 86 and are spaced 90° part at locations where the magnet 100 aligns with one of the posts 102 whenever the windings 92 and 94 are aligned with the magnetic poles 96 and 98. Alignment of the magnet 100 adjacent to one of the posts 102 acts to releaseably latch the rotor 88 in place to latch the damper 80 in its open and closed positions without the need for mechanical stops.

The stator 90 is preferably secured to a printed circuit board 104 (FIG. 3) that is secured to housing 86 and contains circuitry providing an interface between the motor and a control circuit that controls the open and closed position of the damper in a manner that will be explained more fully. Each damper shaft 82 is directly connected with the rotor 88 so that the damper can be quickly rotated between its open and closed positions. The energizing current to the windings 92 and 94 is preferably momentary current that is applied only for sufficient time to place the rotor into rotation. When the rotor has turned through an arc of 90°, it is latched in place by the magnetic attraction between the magnet 100 and the metal stud 102 that is then in alignment with the magnet. Consequently, the dampers 80 are quickly rotated between the open and closed positions and are latched in whichever position they are rotated to by the magnetic latching arrangement. This is all accomplished without the need for mechanical stops or seals on the motor or damper.

While the dampers 80 are preferably butterfly type dampers of the type shown, other types of dampers can be used, including shutter type dampers, slide valves or other suitable types of damper mechanisms having a suitable actuator.

The damper mechanism of the present invention is characterized by the ability to replace other dampers to improve system performance. By way of example, a damper mechanism of the type shown in U.S. Pat. No. 6,019,677 can be replaced by the damper of the present invention.

With reference to FIG. 2, each of the rooms 36 may be equipped with a thermostat 106 or other sensor. The thermostat 106 may be set at a selected temperature set point and may be provided with a sensing element for sensing the ambient air temperature in the room 36. Signals from each thermostat 106 or other sensor are provided to the control circuitry for the dampers along suitable wiring 108.

With continued reference to FIG. 2 in particular, the ceiling 40 above each room 36 is provided with one or more return registers 110 located between the supply plenums 48. A return plenum 112 is provided in the space 42 and occupies the part of the space that is not occupied by the supply plenums 48. The return plenum 112 receives air through the return grills 110 and connects through a return duct 114 with the suction side of the fan 46.

Figure 8:
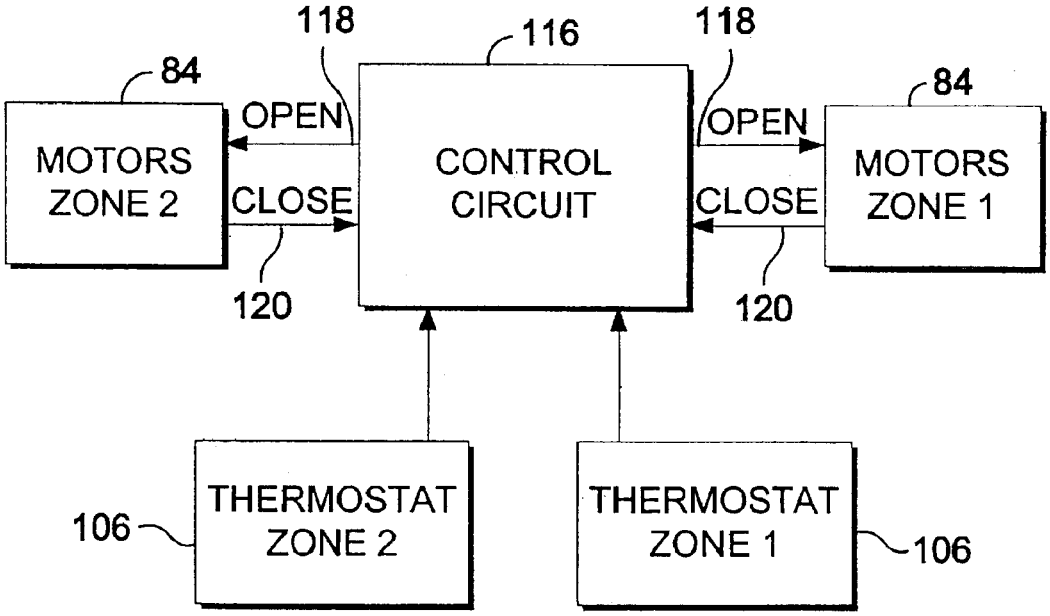
FIG. 8 is a schematic diagram of a control system that may be used with an air delivery system in accordance with the present invention.

The control system for the dampers is an important aspect of the invention and is illustrated schematically in FIG. 8. A control circuit 116 receives input signals from the thermostats 106 or other sensors in the different rooms 36. Based on the signals received from the thermostats 106 or other sensors (which may sense various conditions such as air temperature, humidity, mean radiant space temperature, oxygen depletion, carbon dioxide excess or other conditions requiring conditioned air), the control circuit 116 provides control signals to the motors 84 which operate the dampers for the different rooms 36. The control circuit 116 may provide an "open" signal to motor 84 on line 118 and a "close" signal to motor 84 on line 120. When an open signal is applied on line 118, the motor 84 is activated to rotate the corresponding damper 80 to the open position, and the damper remains latched in that position until a close signal is provided on line 120. Then, the motor rotates the damper to the closed position.

The control of the dampers is a unique aspect of the present invention and involves assigning to each of the dampers a duty cycle having a fairly short duration, normally under two minutes and often amounting only to seconds. During each duty cycle, the damper 80 is maintained open (or "on") for a time period that is dependent upon the set point temperature and the actual temperature in the space. During the remainder of each duty cycle, the damper is maintained closed (or "off"). The duration of each "open" or "on" time period is adjusted in order to maintain the set point temperature. By way of example, if the maximum air flow volume for one of the rooms 36 is 100 cfm, the damper can be maintained open during the entirety of each duty cycle in order to provide 100 cfm to the room. If the duty cycle is 60 seconds long, the damper can be maintained open for 48 seconds of each duty cycle and closed for 12 seconds in order to deliver 80 cfm to the space. To provide 40 cfm, the damper can be maintained open for 24 seconds and closed for 36 seconds.

Other duty cycles can be used. For example, the duty cycle can be only 10 seconds or less long, and the damper will then normally open and close relatively often. Conversely, if the duty cycle is two minutes long, then the damper will open and close relatively infrequently. The length of the duty cycle can be selected to meet whatever conditions are expected, depending upon the many variables that are involved. Normally, the duty cycle will have a duration shorter than temperature changes that the thermostat or other sensor can sense. It is contemplated that in most applications, the duty cycle will be 12–60 seconds.

As a typical operational example, there may be a duty cycle of 12 seconds in a system having a maximum airflow capacity of 100 cfm. When the load is 50%, the damper would be open for six seconds of each duty cycle and closed for the remaining six seconds of each duty cycle in order to provide an average airflow of 50 cfm. During the "on" part of the duty cycle, 100 cfm flows into the room. During the "off" cycle, there is almost no air delivered to the room, although a small amount of leakage is intentionally allowed as being beneficial for maintaining a steady state in the plenum.

Contrasting this with a conventional modulated damper system, the damper would be modulated to a half open position until 50 cfm was delivered continuously to the space. With a conventional "on/off" system, the air supply would be on for five minutes or so and then off for five minutes or so to provide an average operational time of 50%. In this type of system, the "on" cycle is typically five minutes, as compared to a six second "on" cycle with the system of the present invention.

The present invention contemplates that the fan 46 will operate continuously and will maintain the plenums 48 at a constant and relatively low pressure. By way of example, the typical plenum pressure is less than 0.10 inch wg and more preferably approximately 0.05 inch wg, with an internal loss of 0.01 inch wg or even less in most cases. Thus, there is a low pressure drop through the terminal units 54 in order to maintain the passage of air at a level below the human hearing range. Also, whenever the damper 80 is open for the terminal unit 54, the air velocity and throw is constant in order to achieve thorough mixing and efficient distribution of the heated or cooled air throughout the room 36.

It is contemplated that each space that is being supplied with conditioned air will be equipped with a relatively large number of terminal units 54. Ten or more terminal units per space is not unusual, although more or less can be used. In order to maintain stable fan static pressure and airflow stability, the terminal units 54 for a particular space are synchronized such that their duty cycles are initiated at different times. For example, the terminal units 54 which supply one of the rooms 36 can be connected in a daisy chain fashion so that the second terminal begins its duty cycle at a time delayed relative to the start of the duty cycle for the first terminal. Similarly, the third terminal is delayed in the initiation of its duty cycle and so on. This staggered arrangement of the duty cycles avoids a condition where the fan senses the airflow going from full value to zero and vice versa almost instantaneously which would happen if all of the terminals were open and closed at the same time. By virtue of this staggering of the duty cycles for the terminals, the fan stability and airflow stability are enhanced considerably.

In operation of the air delivery system, each of the terminals 84 is "on" during part of its duty cycle and "off" during the remainder of its duty cycle. During the "on" part of each duty cycle, the damper 80 is fully open to provide maximum air into the room in order to supply conditioned air (heated, cooled or otherwise treated) for satisfying the load conditions. During the "off" portion of the duty cycle, the damper 80 is fully closed to block the flow of conditioned air into the room. The thermostat 106 continuously senses the conditions in the room 36 and signals the control circuit 116 to provide a comparison with the set point temperature. For example, if the duty cycle is set at 12 seconds with 6 seconds on and 6 seconds off during each duty cycle in a heating mode, and the temperature in the room 36 is lower than the set point temperature, the control circuit 116 takes corrective action by increasing the "on" part of the duty cycle and decreasing the "off" part of the duty cycle. The "on" part of the duty cycle may be increased to 7 seconds and the "off" time reduced to 5 seconds. If the set point temperature is then satisfied, this condition is maintained. If the set point temperature is exceeded in the heating mode, the "on" portion of each duty cycle is decreased and the "off" portion is increased as necessary to maintain the set point temperature. A similar process takes place during the operation of the system in the cooling mode.

It is noteworthy that the duty cycles are set at a relatively short duration that is not long enough for the thermostat 106 to sense temperature changes during any given duty cycle. The control circuit 116 does not react to any conditions during any individual duty cycle but rather is responsive to the average conditions that result from a relatively large number of duty cycles. The average rate of flow that is effected over time by the on/off operation of the dampers is controlled by the control system. The flow that is provided in the system is an average based on a large number of on/off cycles that are not individually detected by the thermostat or by the occupants of the space.

A number of advantages are obtained by this technique. Because the damper is either fully open or fully closed, the discharge is always at the same air velocity, the same mass, the same mixing, the same kinetic energy, the same momentum, the same induction and the same throw. The acoustical problems and lack of thorough mixing that result from prior systems are overcome by the "binary" nature of the system of the present invention which essentially provides a number of "pulses" of conditioned air at much faster intervals than occur with conventional "on/off" systems. Also, a low pressure supply can be used to advantage.

While the terminal unit shown is advantageous in many respects, other types of air diffusers can be used. Outlet configurations such as a linear slot configuration and various other configurations can be employed.

It is contemplated that the duty cycle for each terminal 54 will be the same as for other terminals that serve the same space. However, this is not necessary in all cases. It is also contemplated that the duty cycle can be constant over time and that only the portion of each duty cycle that is "on" will change in order to meet the load conditions, or the duty cycle can be lengthened or shortened if necessary or desirable to meet the load and maintain effective operation of the system.

It is contemplated that the terminal units 54 which serve a given room 36 will be spaced apart uniformly in a grid pattern to provide the air at equally spaced locations throughout the room. While ceiling mounted terminals 54 can be used, it is also possible to provide floor mounted registers or wall mounted registers. Further, although the invention lends itself well to the plenum type system shown in FIG. 2, it can also be used with a system having separate duct work such as shown in FIG. 1. The plenum system is desirable because the height of the space 42 can be reduced substantially compared to the height required in the space 20 of a system that requires extensive duct work.

The system of the present invention entails an air supply device supplying air at a substantially constant pressure, an air distribution means which may be a plenum or duct and is preferably a plenum, an air terminal for discharging the air, and a device such as a thermostat for sensing a condition in the space to which the air is to be supplied. It is a particular feature of the invention that a system of this type allows the use of a terminal device that does not need balancing. Also, variable air volume devices and constant air volume devices can easily be mixed in a single system. In this respect, some or all of the terminal units can be equipped with dampers to provide variable air volume capability, while other of the terminal units can lack a damper so that they always operate under constant air volume conditions. It is important in connection with the air terminal that its air flow volume has a fixed maximum volume that is not a function of the damper but instead depends upon the discharge area of the outlet from the terminal.

In regard to the terminals, it is important that they are pressure dependent devices. Because the terminal air volume is controlled by the pressure and the duration of the damper open condition during each duty cycle, the use of pressure dependent terminals allows the pressure to be varied in order to achieve varying throw characteristics of the terminal, while the damper provides the correct volume independently of the pressure. As a result, one terminal size can be provided and will cover a wide range of applications. Additionally, noise and turn down problems that are characteristic of conventional air terminals are avoided due to the volume control methodology employed in the present invention.

As previously indicated, the system of the present invention lends itself well to a system that uses plenums such as the plenums 48 and the return plenum 112 rather than conventional ductwork. One advantage of such a plenum system is that there is considerable space available above the ceiling 40 that is not occupied by ductwork so that other devices can be wired, plumbed or otherwise equipped in the space above the ceiling. For example, an integral ceiling unit can be provided that incorporates a terminal unit, a return register, and one or more other devices, including fire sprinklers, lights, smoke detectors and other devices. The fixtures, pipes, conduits, electrical wiring and other components required in systems of this type can make use of the space that is available due to the absence of ductwork. By eliminating duct work and locating the return and supply plenums in close proximity, it is possible to construct a multi-function device with integration of fixtures heretofore impractical. For example, prior attempts to integrate a light fixture with a supply duct/air diffuser have resulted in structures that are difficult to build, install and apply. The system of the present invention eliminates these problems.

The damper construction and its direct connection with the motor 84 is advantageous primarily because the damper can be opened and closed rapidly without undue noise and there is minimal wear because of the absence of the need for mechanical stops. Because the dampers 80 are opened and closed much more frequently than in a conventional system, abrasion and other wear should be avoided, as is the case with the magnetic latch arrangement provided for the dampers of the present invention.

Figure 9:
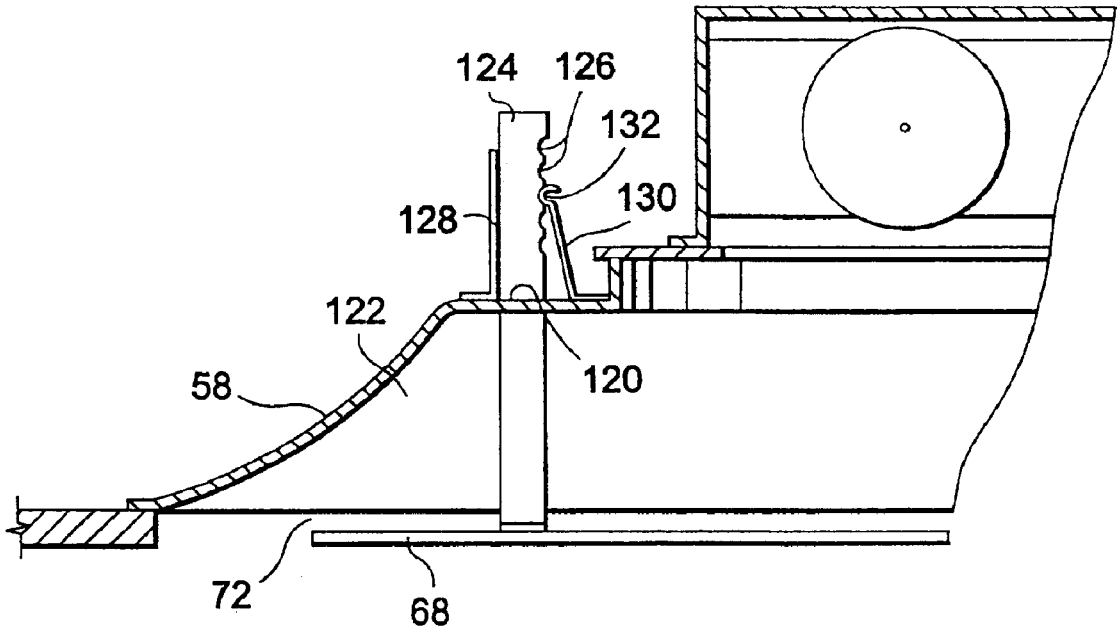
FIG. 9 is a fragmentary diagrammatic view of an alternative terminal unit having an adjustable baffle plate.

FIG. 9 depicts an alternative terminal unit in which the baffle plate 68 is adjustable up and down to vary the size of the outlet 72. The hood 58 has four corner areas 120 that are each provided with an extended ledge 122. Rather than being suspended on the fixed hanger brackets 70 as in the construction of FIG. 3, the adjustable plate 68 of FIG. 9 is carried on the lower ends of adjustable hangers 124 having a plurality of notches 126 on one edge. The hangers 124 are guided along guide elements 128 mounted on the ledges 122.

A spring leg 130 is provided for each hanger 124. The legs 130 are mounted on the ledges 122 and terminate at their top ends in curved heads 132 that are received closely in the notches 126 to hold the hangers in place.

The plate 68 can be pushed upwardly to engage the next lower notch 126 with the head 132 in order to secure the plate 68 at a higher position to decrease the size of the outlet 72. Conversely, the plate 68 can be lowered to engage the next higher notch 126 with the head 132, thereby increasing the size of outlet 72. In this way, the outlet size can be adjusted as desired. The heads 132 have snap fits with the notches 126 to provide an audible click as well as a sense of feel when the heads are received in the notches. Virtually any number of notches can be provided, and they may be spaced apart as desired, in order to provide a wide range of adjustment as well as fine adjustments within the permissible range.

The air terminal unit shown in FIG. 9 is advantageous in a number of respects which are obtained primarily from its construction and its incorporation in a system that uses a relatively low and uniform air distribution pressure applied to plenums such as the plenums 48 shown in FIG. 2. By using such a system and the air terminal shown in FIG. 7, air is delivered to the space in a controlled manner without throttling. The terminal unit has a discharge area that is the only restriction of the airflow. There are no intermediate modulating flow control dampers between it and the plenum pressure, as the dampers 80 are "on/off" digital devices that do not throttle the airflow in a traditional manner and therefore do not change the volume of air delivered by the terminal when the damper is open. Consequently, the plenum pressure and the terminal area of the outlet 72 set the maximum flow rate from the terminal. The plenum pressure is not reduced to modulate the flow. Further, the plenum location adjacent to the ceiling 40 with the large plenum area provides a radiant cooling/heating effect that is beneficial.

Beneficial results and performance are made possible due to the plenum having a constant pressure, the construction of the terminal unit, and the modulation method in which the dampers are either fully open or fully closed. Combining these three features together in a system results in the elimination of air balancing, it provides better air distribution performance, and allows the components to be reusable and/or adjustable in place.

The terminal of the present invention can be manufactured in a single size, in contrast to traditional terminals that are normally made available in a wide assortment of neck or duct sizes. Although the physical size of the terminal unit is fixed, the outlet opening area is adjustable due to the adjustability provided for the baffle plate 68. Accordingly, a single terminal device can be applied to a wide variety and range of applications, and it can be moved or reapplied without the need to obtain another device having a different size. The ability to provide a terminal unit having a single size reduces the need to manufacture, inventory and supply a multitude of devices as has been required in the past.

For constant volume applications, the terminal unit can be installed without the need for air balance. The terminal can be set at a fixed flow without the need for balancing because all terminals receive essentially the same pressure from the plenum, the terminal flow characteristics are set by its physical construction, and modulation of flow volume does not employ throttling.

The advantages of the terminal unit include its capability in being useful in a wide range of applications. For example, the terminal unit can be installed in a small office and set at a low maximum flow rate, or it can be installed in a large open area and set at a high flow rate. The terminal unit can be used with the pulse modulation system of the present invention involving variable air volume, or it can be used without such a system in a constant volume zone. As a result, one device can replace literally hundreds of conventional terminals that must be sized according to the duct size and the required volume/pressure conditions and the desired airflow characteristics.

The terminal unit can be easily relocated, added or deleted due to the nature of the system of the present invention. Because of the use of a constant pressure supply plenum, the control methodology that is employed, the elimination of ducts, the air balance and the nature of the control system, terminals can be added, deleted or moved without difficulty. In a conventional system having ducts, adding a terminal requires resizing the equipment, including the terminal, the ducts, dampers and other components. In the system of the present invention, the duty cycle adjusts automatically when a terminal is added, moved or deleted. The "size" of the terminal can be adjusted by adjusting the baffle plate rather than requiring the terminal to be changed and rebalanced.

When the maximum flow of the terminal unit is adjusted by repositioning the baffle plate 68, there is an impact on the throw. Even though the terminal is a constant velocity device, the reduction in the volume of the plume when the baffle plate 68 is adjusted upwardly reduces the throw somewhat. In smaller areas, the reduction in the throw is beneficial. In addition, when the terminal unit is used without a damper, adjustment of the baffle allows the terminal to better balance the load in the space.

Traditional air delivery systems encounter difficulty in attempting to mix constant volume air distribution and variable volume air distribution. With the system of the present invention and the adjustable terminal unit, zones that are constant in volume can be established along with other zones that are variable in volume. The control damper on the terminal unit can be installed either initially or added later if the unit is to be converted in the field. This flexibility is permitted because there is no need for balancing. The change over from constant volume to variable volume or from variable volume to constant volume, and the relocation of terminals or changing of the terminal volume, can all be accomplished without special equipment or the need to discard the existing device.

Figure 10A:
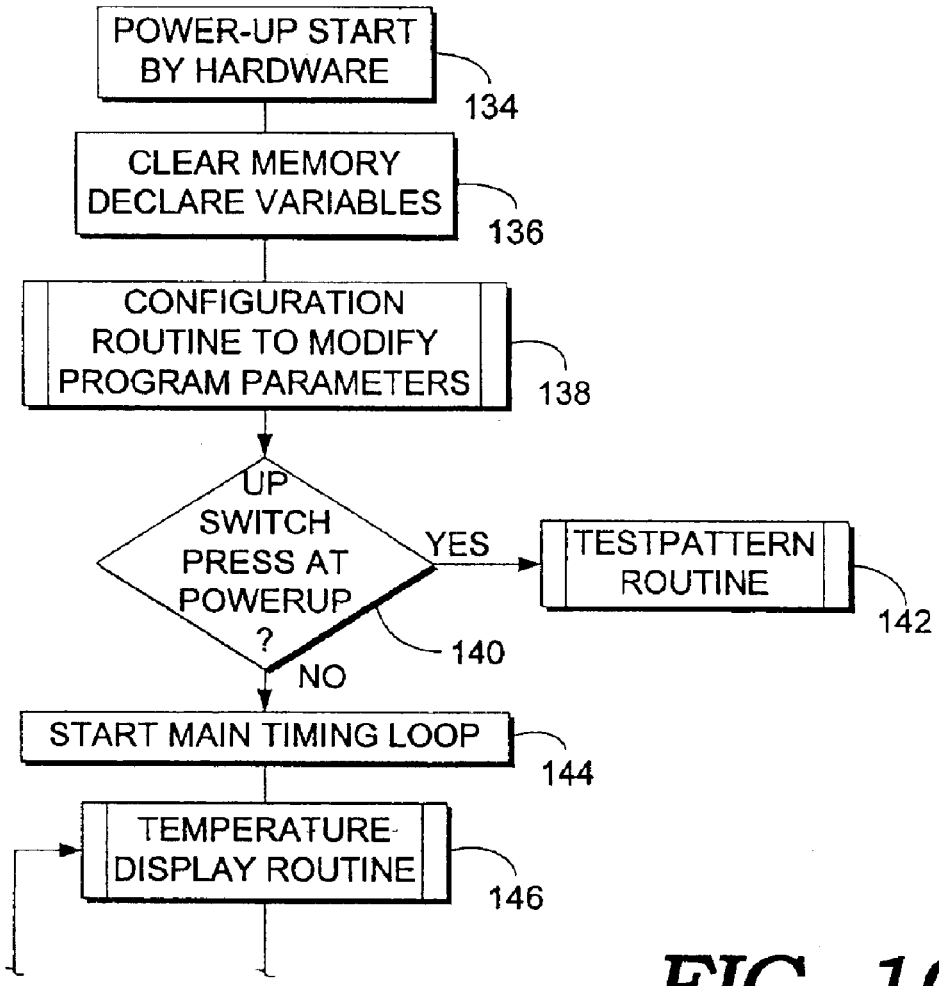
FIG. 10 is a flow diagram of a control system that may be used with an air delivery system in accordance with the present invention.

FIGS. 10–14 are flowcharts for a system that may be used to control the opening and closing of the dampers 80. FIG. 10 depicts the main routine that may be used for operation in a cooling mode using a thermostat or other temperature sensor to detect the air temperature in the room to which cooling air is supplied.

With reference to FIG. 10, a power up routine is carried out in block 134. In block 136, the memory is cleared and the variables are declared. Next, a configuration routine in block 138 modifies the program parameter and checks a set of DIP switches that are used to configure the device. If a test switch is pressed at power up as determined in block 140, a test routine for setup of the system can be carried out in block 142. Otherwise, the main timing loop is initiated in block 144.

When the system is initiated, the temperature that is sensed by the thermostat is displayed by LEDs or otherwise, as indicated in block 146. Next, as indicated in block 148, the thermistor value is read and converted into a digital temperature. In block 150, the temperature is compared with the set point temperature to determine whether it is above the set point temperature. If it is not, a determination is made in block 152 as to whether the sensed temperature is below the set point temperature. If it is not, the temperature is at the set point. The "integral time" value is set equal to zero in block 154 and the program continues as indicated at block.

If it is determined in block 150 that the temperature that is sensed is above the set point temperature, a determination is made in block 158 as to whether the temperature is above the set point by five degrees or more. If it is not, an increase open time routine is carried out as indicated at block 160.

Figure 11:
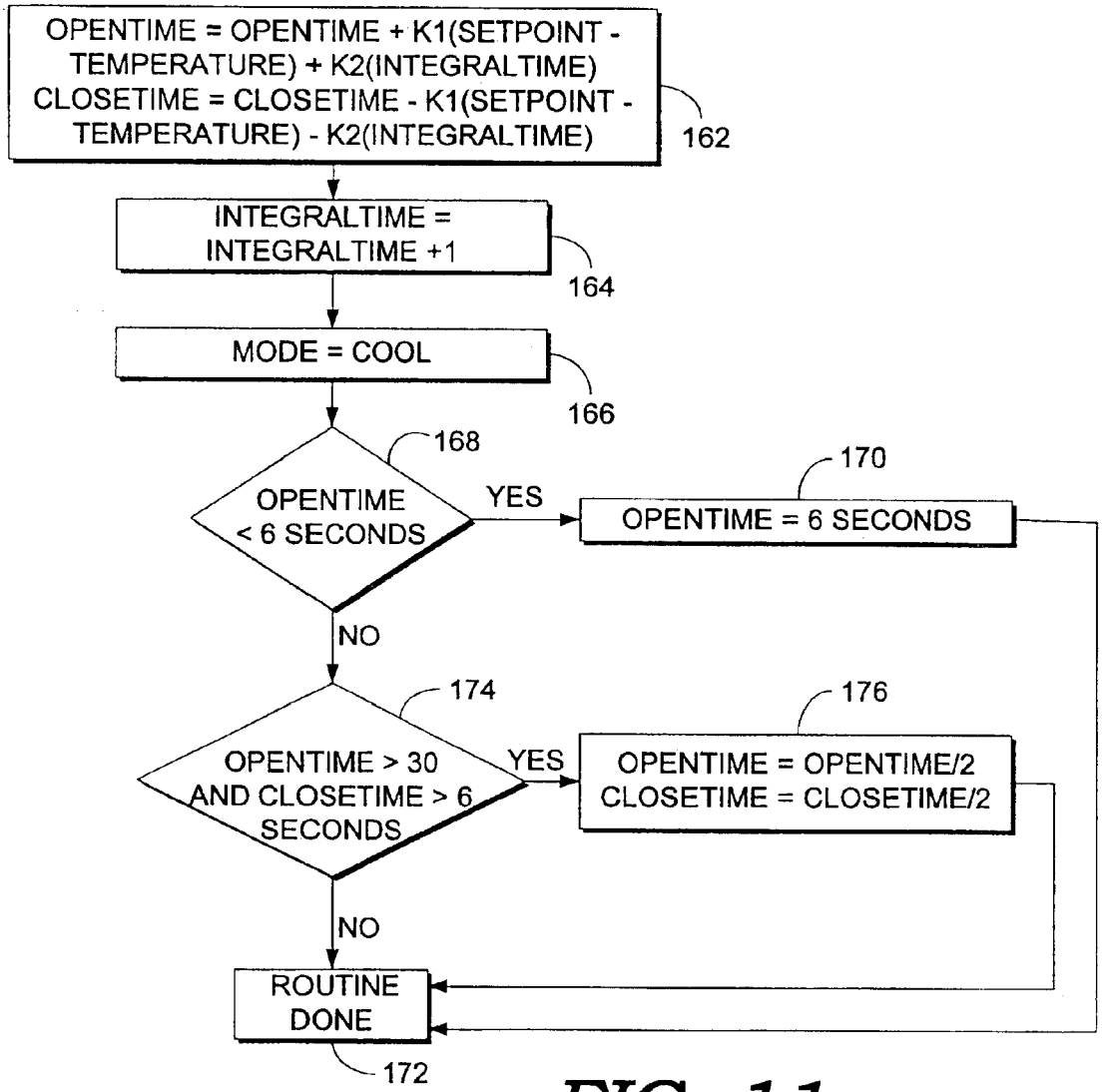
FIG. 11 is a flow diagram of an increase open time routine used in the system of FIG. 10.

FIG. 11 depicts the increase open time routine that is carried out when the temperature is above the set point by less than five degrees. Under these conditions, it is desirable to increase the open time of the dampers 180 during each duty cycle in order to decrease the temperature in the room. Normally, the open and close times are changed by lengthening the open time and decreasing the close time by an equal amount. The amount of change may be made dependent upon two constants (K1 and K2) that are a function of the set up of the device and the time of the loop set by the processor execution. The intervals between the pulses that open and close the dampers are a function of the temperature deviation from the set point and an integration factor ("integral time") that represents the amount of time the temperature has deviated from the set point. By way of example, in block 162 in FIG. 11, the open time can be reset as the previous open time plus the constant K1 times the temperature deviation (set point minus actual temperature) plus the constant K2 times the integral time value. The close time can be calculated as the former close time minus K1 times the temperature deviation minus K2 times the integral time. Thus, the open time is increased by a duration that is equal to the duration of the decrease in the close time, with the duty cycle remaining constant under these conditions.

After the open time and close times have been calculated in block 162, the integral time value is incremented by one in block 164 and the mode block 166 indicates that the system is in the cooling mode.

It is desirable under most conditions to keep the damper open for at least six seconds as a practical matter, although this is not always necessary. Further, it is desirable to shorten the open and/or close durations if they both become unduly long. As an example, a four second duty cycle where the open time and close time are both two seconds, a 20 second duty cycle in which the open and close times are both 10 seconds, and a 60 second duty cycle in which the open and close times are each 30 seconds all provide an "average flow rate" of 50% of the maximum. However, cycles that are unduly short such as two seconds open and two seconds closed and cycles that are unduly long (normally in excess of 30 seconds) should be avoided in order to maintain the system operating properly.

Based on these conditions, a determination is made in block 168 if the open time is less than six seconds. If it is, the open time is set at equal to six seconds in block 170 and block 172 is entered indicating that the increase open time routine is complete. If the open time is not less than six seconds, a determination is made in block 174 as to whether the open time is greater than 30 seconds and the close time is greater than six seconds. If both conditions are not met, block 172 is entered. However, if the open time is greater than 30 seconds and the close time is greater than six seconds, both the open time and the close time are set at half their previous durations in block 176, and block 172 is then entered. In this fashion, the open time is usually maintained at or above six seconds, while excessive open times above 30 seconds are usually avoided. When the increased open time routine is complete, the main routine continues at block 156.

With reference to FIG. 10, if the temperature is below the set point as indicated in block 152, a determination is made in block 178 as to whether the temperature is below the set point by two degrees or more. If it is not, a decrease open time routine is carried out as indicated in block 180.

Figure 12:
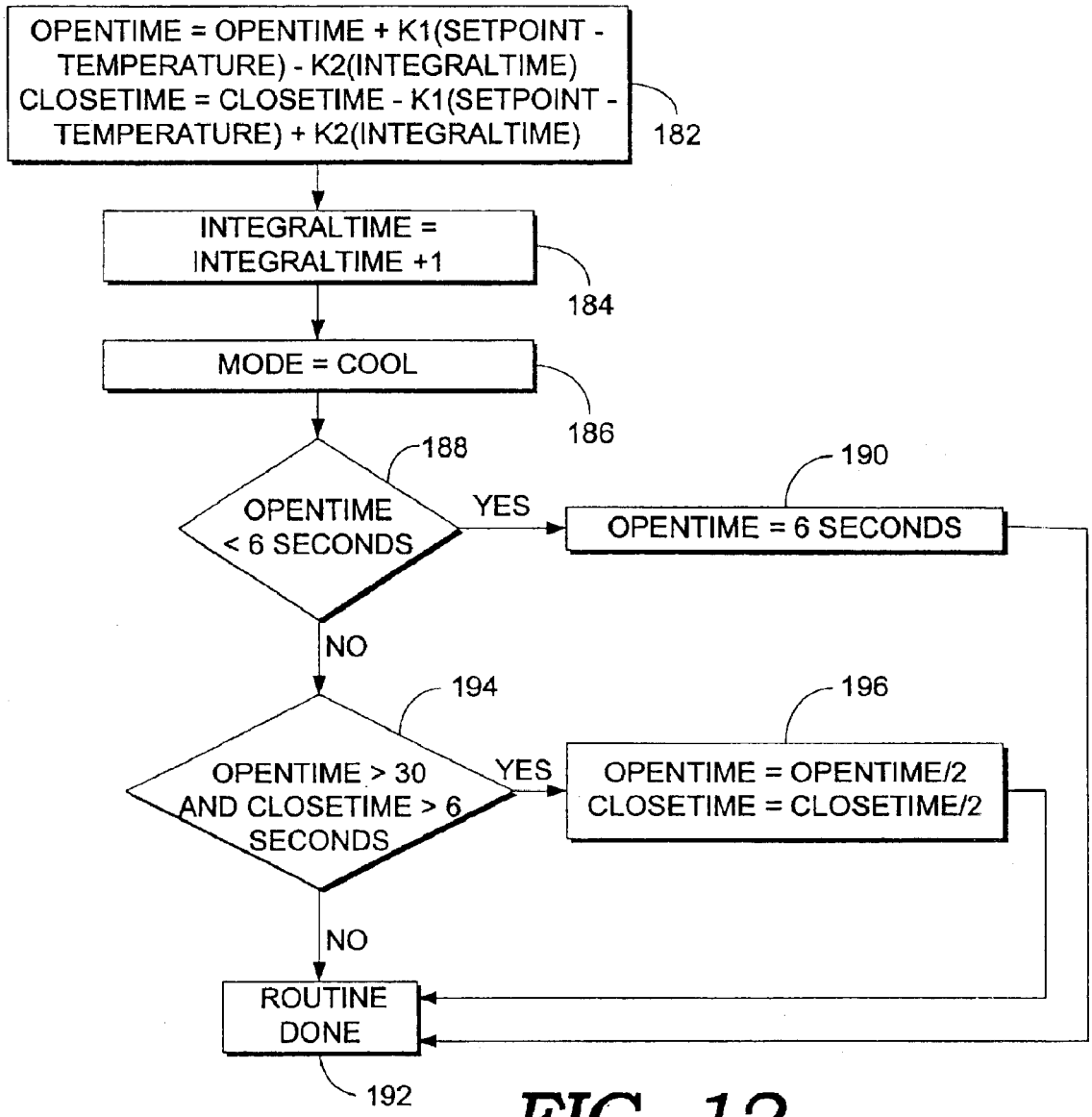
FIG. 12 is a flow diagram of a decrease open time routine used in the system of FIG. 10.

The decrease open time routine is depicted in FIG. 12 and involves determining new open and close times in block 182. The open time is calculated as the former open time plus the constant K1 times the temperature deviation (calculated as a negative value) minus the constant K2 times the integral time value. The close time is calculated as the former close time minus K1 times the (negative) temperature deviation plus the constant K2 times the integral time. The integral time is incremented by a value of one in block 184 and an indication of the cooling mode is provided in block 186. Similarly to the routine shown in FIG. 11, a determination is made in block 188 as to whether the open time is less than six seconds. If it is, it is set equal to six seconds in block 190 and the routine is completed in block 192. If the open time is not less than six seconds, a determination is made in block 194 as to whether the open time is greater than 30 seconds and the close time is greater than six seconds. If both conditions are not satisfied, the routine is completed in block 192. If the open time is greater than 30 seconds and the close time is greater than six seconds, both times are cut in half as indicated in block 196, and the routine is then completed in block 192. When the routine depicted in FIG. 12 is completed, the main routine continues in block 156.

Referring again to FIG. 10, when the main routine continues in block 156, a determination is made in block 198 of whether the damper is open and if so whether the time set for it to remain open has elapsed. If it has, a close pulse output routine is carried out in block 200. If it has not, there is a no close pulse time delay in block 202 and a determination is made in block 204 as to whether the damper is closed and if so whether the close time has elapsed. If it has not, there is a no open pulse time delay in block 204*a* and the program loop of the main routine is complete (block 205) and is repeated. If the damper is closed and the close part of the cycle is complete, an open pulse output routine is effected as indicated in block 206.

If it is determined in block 158 that the temperature is above the set point by five degrees or more, the damper is set to be constantly open as indicated in block 208, and the open pulse output routine in block 206 is carried out.

Figure 13:
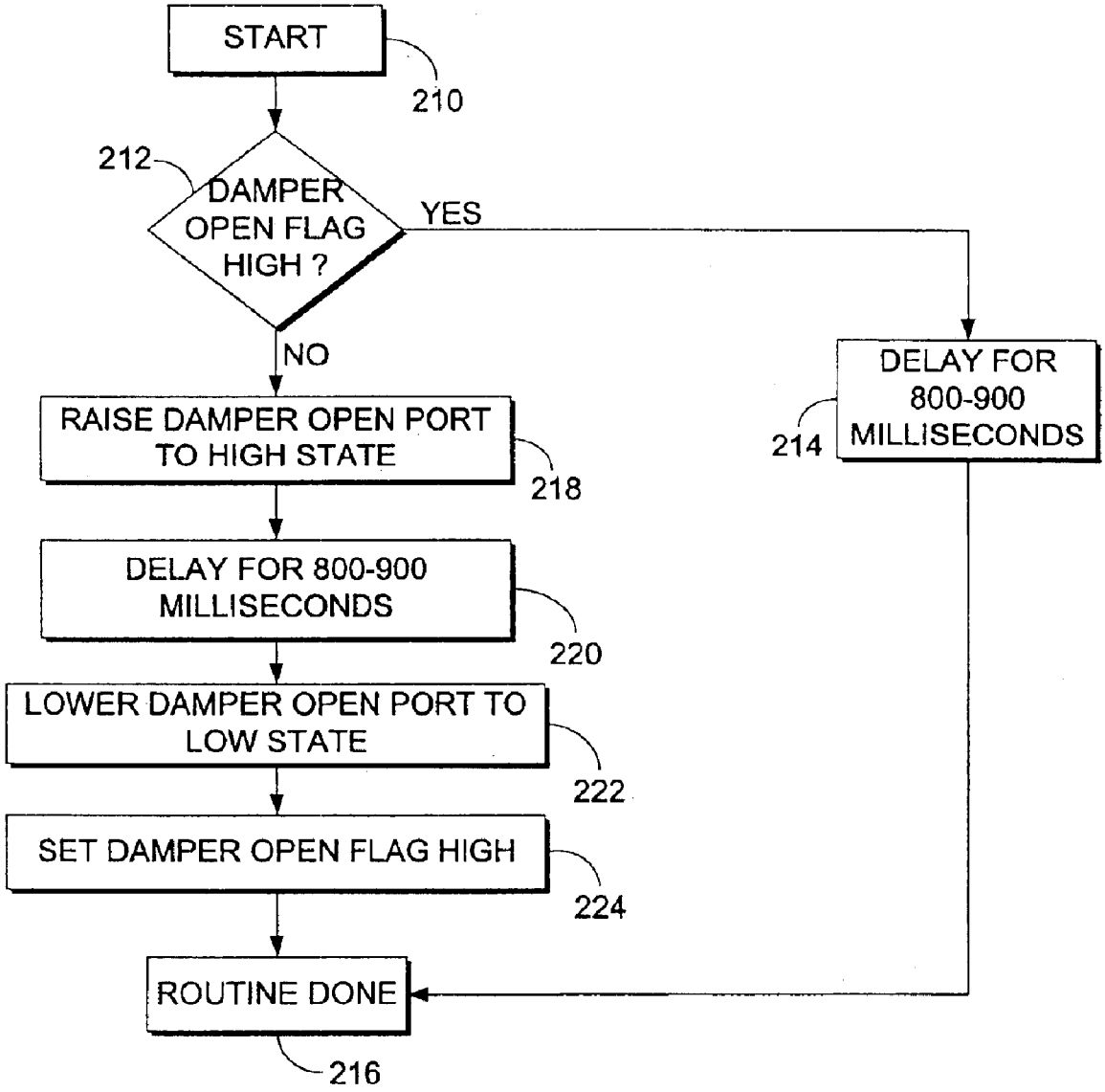
FIG. 13 is a flow diagram of an open pulse output routine used in the system of FIG. 10.

The open pulse output routine is depicted in FIG. 13 and includes a start block 210. In block 212, a determination is made as to whether the damper open flag is in a high state. If it is, there is a selected delay as indicated in block 214 and the routine is completed as indicated in block 216. If the damper open flag is not high, the damper open port is set in a high state in block 218. After a delay in block 220, the damper open port is lowered to a low state in block 222 and the damper open flag is set to a high state in block 224 prior to completion of the routine in block 216. When the open pulse output routine depicted in FIG. 13 has been completed, the main routine is complete (block 205) and is repeated.

In the main routine (FIG. 10), if the temperature is below the set point by two degrees or more, the damper is set in a constantly closed condition as indicated in block 226, and the close pulse output routine in block 200 is initiated.

Figure 14:
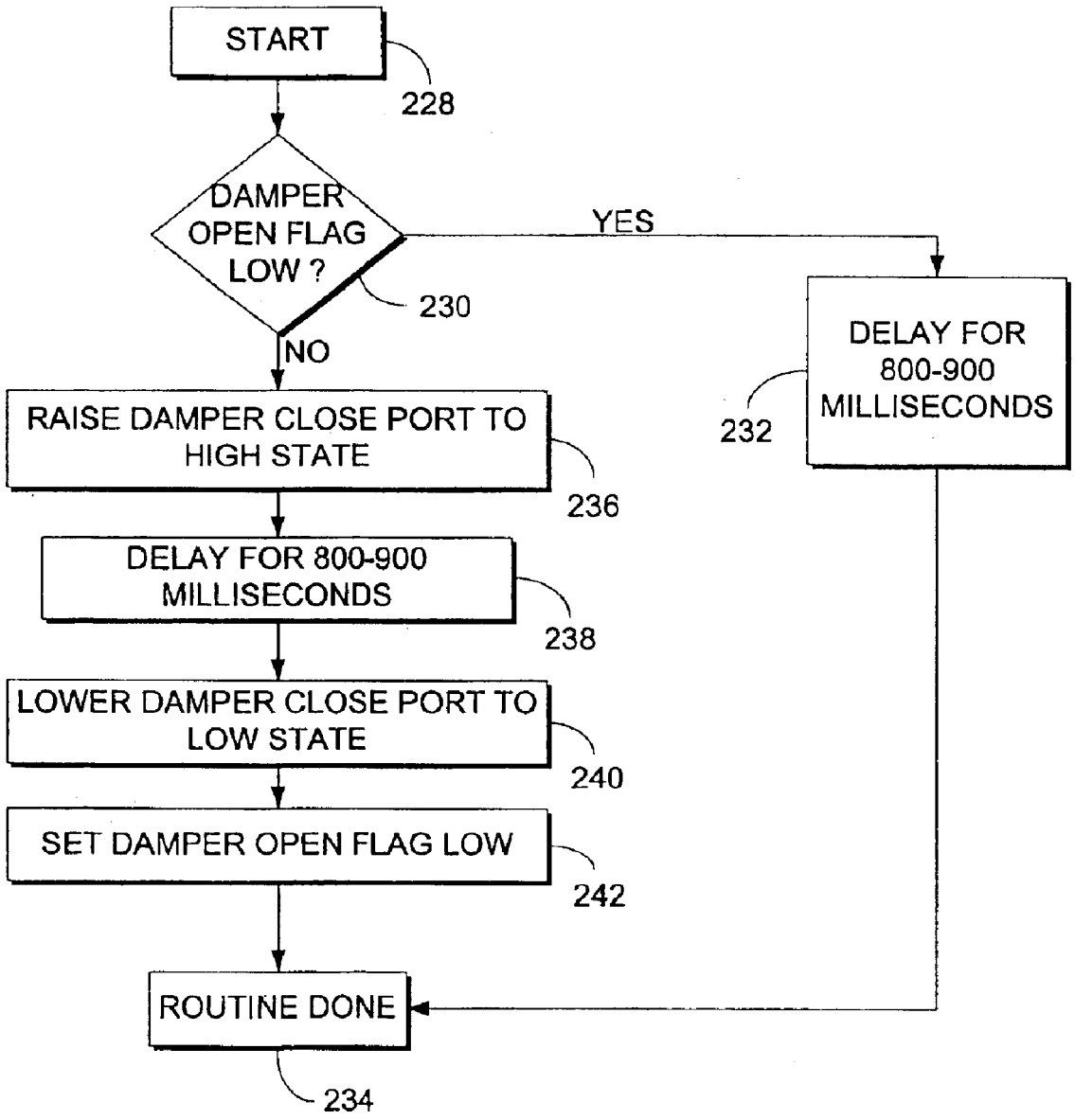
FIG. 14 is a flow diagram of a close pulse output routine used in the system of FIG. 10.

The close pulse output routine is depicted in FIG. 14 and is similar to the open pulse output routine. A start block is included at 228, and a determination is made in block 230 as to whether the damper open flag is low. If it is, following a delay in block 232, the close pulse output routine is completed as indicated in block 234. If the damper open flag is not low, the damper close port of the processor is raised to a high state in block 236. Then, following a delay in block 238, the damper close port is lowered to the low state in block 240 and then the damper open flag is set low in block 242, after which the routine is done. When the close output pulse routine has been completed, the main routine is complete (block 205) and is repeated.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A method of delivering conditioned air to a space, comprising the steps of:

sensing a condition in the space;

selecting a duration for a duty cycle that is less than two minutes;

selecting a time period during each duty cycle which is dependent on the condition sensed in the space;

applying conditioned air to the space during said time period of each duty cycle; and stopping the application of conditioned air to the space during the part of each duty cycle that does not include said time period.

2. A method as set forth in claim 1, wherein said step of applying conditioned air to the space comprises applying conditioned air to the space at a substantially constant velocity and volume rate of flow during said time period of each duty cycle.

3. A method as set forth in claim 1, wherein the step of sensing a condition in the space comprises sensing an air temperature in the space, and including the step of adjusting the duration of said time period in response to changes in the temperature sensed in the space.

4. A method as set forth in claim 1, wherein said step of applying conditioned air to the space comprises applying conditioned air to the space at a plurality of different locations therein.

5. A method as set forth in claim 4, wherein:

said time period for each of said locations has substantially the same duration; and said time period for at least one of said locations is initiated during each duty cycle at a later time than said time period is initiated for another of said locations during each duty cycle.

6. Apparatus for delivering conditioned air to a space, comprising:

a source of conditioned air, a terminal unit communicating with said source to receive conditioned air therefrom and apply the air to the space, said terminal unit including a damper having a fully open condition wherein conditioned air is applied to the space by said terminal unit and a closed condition wherein the flow of conditioned air from said terminal unit is blocked by said damper;

a sensor in the space sensing a selected condition therein; and a control system having sequential duty cycles each of a selected duration, said control system being responsive to the condition sensed by said sensor to effect the fully open condition of said damper for a selected time period during each duty cycle and the closed condition of said damper for the part of each duty cycle that does not include said selected time period.

7. AApparatus as set forth in claim 6, wherein said source supplies conditioned air to said terminal unit at a substantially constant pressure.

8. Apparatus as set forth in claim 7, wherein said source supplies conditioned air to said terminal unit at a pressure less than about 0.10 inch wg.

9. Apparatus as set forth in claim 6, wherein said sensor is operable to sense an air temperature in the space and said control system is arranged to adjust the duration of said selected time period when the temperature sensed by said sensor changes.

10. Apparatus for delivering conditioned air to a space, comprising:

a sensor for sensing a selected condition in the space;

a plurality of terminal units each receiving conditioned air for application to the space, said terminal units being spaced apart in the space;

a damper for each terminal unit having a fully open condition wherein conditioned air is applied to the space and a closed condition wherein the flow of conditioned air to the space is blocked, each damper having successive duty cycles each including a selected time period dependent on the condition sensed by said sensor; and a control system for effecting the fully open condition of each damper during said selected time period of each duty cycle and the closed condition of each damper during the part of each duty cycle that does not include said selected time period, said control system initiating the duty cycles of at least one damper at a different time than the duty cycles of another of said dampers is initiated.

11. Apparatus as set forth in claim 10, wherein:

said duty cycle for each damper has substantially the same duration; and said control system is arranged to vary the duration of said selected time period for each damper in response to changes in the temperature sensed by said sensor.

12. Apparatus for delivering conditioned air to a room having a space located above a ceiling overlying the room, said apparatus comprising:

a source of conditioned air;

an enclosed supply plenum located in said space immediately above the ceiling and communicating with said source to receive conditioned air therefrom;

a terminal unit on said ceiling arranged to receive conditioned air from said supply plenum and apply the conditioned air to the room;

a temperature sensor in said room for sensing the air temperature therein;

a damper associated with said terminal unit having a fully open condition wherein conditioned air is applied to the room by said terminal unit and a closed condition wherein the flow of conditioned air from said terminal unit is blocked, said damper having successive duty cycles each including a selected time period dependent on the temperature sensed by said sensor;

a control system for effecting the fully open condition of said damper during said selected time period of each duty cycle and the closed condition of said damper during the part of each duty cycle that does not include said selected time period;

a return air plenum in said space separated from said supply plenum and communicating with said source to supply return air thereto from the room; and a return register in the room communicating with said return air plenum to supply return air thereto.

13. Apparatus as set forth in claim 12, wherein said control system is arranged to change the duration of said selected time period of each duty cycle in response to changes in the temperature sensed by said sensor.

14. A method of delivering conditioned air to a space, comprising the steps of:

selecting a duty cycle having a fixed duration comprising a first time period and a second time period together occupying the entirety of said fixed duration;

sensing a condition in the space;

setting said first time period according to the condition sensed in the space;

applying conditioned air to the space during said first time period of each duty cycle;

stopping the application of conditioned air to the space during said second time period of each duty cycle; and varying the duration of said first time period in response to changes in the condition sensed in the space.

15. A method as set forth in claim 14, wherein said duty cycle has a duration les than two minutes.

16. A method as set forth in claim 14, wherein:

said step of applying conditioned air to the space comprises opening a damper past which the conditioned air flows into the space when said damper is open; and said step of stopping the application of conditioned air to the space comprises closing said damper to block the flow of the conditioned air into the space.

* * * * *